US009719713B2

(12) United States Patent
Scarcella

(10) Patent No.: US 9,719,713 B2
(45) Date of Patent: Aug. 1, 2017

(54) REFRIGERATED CARGO CONTAINER, METHOD FOR COOLING A CARGO, METHOD FOR HEATING A CARGO

(71) Applicant: CARRIER CORPORATION, Farmington, CT (US)

(72) Inventor: Jason Scarcella, Cicero, NY (US)

(73) Assignee: CARRIER CORPORATION, Farmington, CT (US)

( * ) Notice: Subject to any disclaimer, the term of this patent is extended or adjusted under 35 U.S.C. 154(b) by 91 days.

(21) Appl. No.: 14/406,782

(22) PCT Filed: Apr. 10, 2013

(86) PCT No.: PCT/US2013/035906

§ 371 (c)(1),
(2) Date: Dec. 10, 2014

(87) PCT Pub. No.: WO2013/187997

PCT Pub. Date: Dec. 19, 2013

(65) Prior Publication Data

US 2015/0153089 A1 Jun. 4, 2015

Related U.S. Application Data

(60) Provisional application No. 61/658,100, filed on Jun. 11, 2012.

(51) Int. Cl.
*F25D 17/02* (2006.01)
*F25D 11/00* (2006.01)
(Continued)

(52) U.S. Cl.
CPC ..... *F25D 11/003* (2013.01); *B65D 88/744* (2013.01); *F25B 1/005* (2013.01);
(Continued)

(58) Field of Classification Search
CPC .... F25D 11/003; F25D 23/061; F25D 19/003; F25D 17/06; B65D 88/744
See application file for complete search history.

(56) References Cited

U.S. PATENT DOCUMENTS 1,914,075 A * 6/1933 Carl ..... B60P 3/20 165/135
3,362,179 A * 1/1968 Kirkpatrick ..... F25B 39/02 62/239

(Continued)

FOREIGN PATENT DOCUMENTS

BE 630149 A 7/1963
CN 1111342 A 11/1995

(Continued)

OTHER PUBLICATIONS

State Intellectuai Property Office of People's Republic China Search Report; Application No. 201380028756.0; Date of Mailing Feb. 22, 2016;3 pages.

(Continued)

*Primary Examiner* — Elizabeth Martin
(74) *Attorney, Agent, or Firm* — Cantor Colburn LLP

(57) ABSTRACT

A refrigerated cargo container includes a cargo container and a refrigeration unit. A plurality of refrigerant tubes are in fluid communication with the refrigeration unit and extend along a roof of the cargo container. The plurality of refrigeration tubes are configured to convey refrigerant there through and cool an interior of the cargo container via natural convection and thermal radiation. A method of cooling a cargo in a cargo container includes flowing a refrigerant through a plurality of refrigerant tubes disposed at a roof of the cargo container. Thermal energy is transferred from container air in the container to the refrigerant thereby cooling the container air. The container air is circulated via natural convection toward the cargo thereby (Continued)

cooling the cargo via thermal energy transfer to the container air. The container air is recirculated toward the plurality of refrigerant tubes.

14 Claims, 5 Drawing Sheets

(51) Int. Cl.

| | |
|---|---|
| ***B65D 88/74*** | (2006.01) |
| ***F25D 19/00*** | (2006.01) |
| ***F25B 1/00*** | (2006.01) |
| ***F25D 17/06*** | (2006.01) |
| ***F25D 17/04*** | (2006.01) |

(52) U.S. Cl.
CPC ..... *F25D 17/04* (2013.01); *F25D 17/06* (2013.01); *F25D 19/003* (2013.01)

(56) References Cited

U.S. PATENT DOCUMENTS

| | | | | |
|---|---|---|---|---|
| 4,434,623 | A | 3/1984 | Weasel, Jr. | |
| 4,448,041 | A * | 5/1984 | Southworth, Jr. | B60P 3/20 62/239 |
| 4,459,821 | A * | 7/1984 | Cabell | B60P 3/20 296/186.4 |
| 2004/0020236 | A1 | 2/2004 | Vince et al. | |
| 2013/0298592 | A1 * | 11/2013 | Hill, Jr. | B60H 1/00364 62/426 |

FOREIGN PATENT DOCUMENTS

| | | | |
|---|---|---|---|
| CN | 1213352 | A | 4/1999 |
| CN | 101501414 | A | 8/2009 |
| DE | 8801105 | U1 | 4/1988 |
| JP | 2005114180 | A | 4/2005 |
| WO | 9428319 | A1 | 12/1994 |

OTHER PUBLICATIONS

Notification of Transmittal of the International Search Report and the Written Opinion of the International Searching Authority, or the Declaration; PCT/US2013/035906; Date of Mailing Aug. 1, 2013.
Notification of Transmittal of the International Written Opinion of the International Searching Authority, or the Declaration; PCT/US2013/035906; Date of Mailing Aug. 1, 2013.
Intellectuel Property Office of Singapore Written Opinion; Application No. 11201408248U; Mailing Date: Dec. 24, 2015; 6 pages.

* cited by examiner

REFRIGERATED CARGO CONTAINER, METHOD FOR COOLING A CARGO, METHOD FOR HEATING A CARGO

BACKGROUND OF THE INVENTION

The subject matter disclosed herein relates to refrigeration systems. More specifically, the subject matter disclosed herein relates to refrigeration of containers utilized to store and ship cargo.

A typical refrigerated cargo container, such as those utilized to transport cargo via sea, rail or road, is a container modified to include a refrigeration unit located at one end of the container. The refrigeration unit includes a compressor, condenser, expansion valve and evaporator coil, all located at the end of the container. A volume of refrigerant circulates throughout the refrigeration unit, and one or more evaporator fans of the refrigeration unit blow a flow of air across the evaporator coil cooling the air and forcing it out into the container.

The cooled air in typical container system is forced out of the refrigeration unit and along a floor of the container. As the cooled air travels away from the refrigeration unit, its temperature increases and it rises in the container and eventually returns to the refrigeration unit. This circulation of cool air from one end of the container to the other end and back again results in uneven cooling of the cargo in the container, since the air forced into the container gets warmer as it travels farther from the refrigeration unit. Further, the cargo positioned at a lower portion of the container will benefit more form the cooling flow than the cargo positioned at an upper portion of the container.

Additionally, the typical refrigeration system for a container is costly and occupies a large amount of space that would otherwise be available for loading cargo.

BRIEF DESCRIPTION OF THE INVENTION

In one embodiment, a refrigerated cargo container includes a cargo container and a refrigeration unit. A plurality of refrigerant tubes are in fluid communication with the refrigeration unit and extend along a roof of the cargo container. The plurality of refrigeration tubes are configured to convey refrigerant there through and cool an interior of the cargo container via natural convection and thermal radiation.

In another embodiment, a method of cooling a cargo in a cargo container includes flowing a refrigerant through a plurality of refrigerant tubes disposed at a roof of the cargo container. Thermal energy is transferred from container air in the container to the refrigerant thereby cooling the container air. The container air is circulated via natural convection toward the cargo thereby cooling the cargo via thermal energy transfer to the container air. The container air is recirculated toward the plurality of refrigerant tubes.

In yet another embodiment, a method of heating a cargo in a cargo container includes heating a flow of refrigerant located in a plurality of tubes. The flow of refrigerant is circulated through the plurality of tubes at the cargo container. Thermal energy is transferred from flow of refrigerant to container air in the container thereby heating the container air, and the container air is circulated via natural convection toward the cargo thereby heating the cargo via thermal energy transfer from the container air. The container air is recirculated toward the plurality of tubes.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

Figure 1:
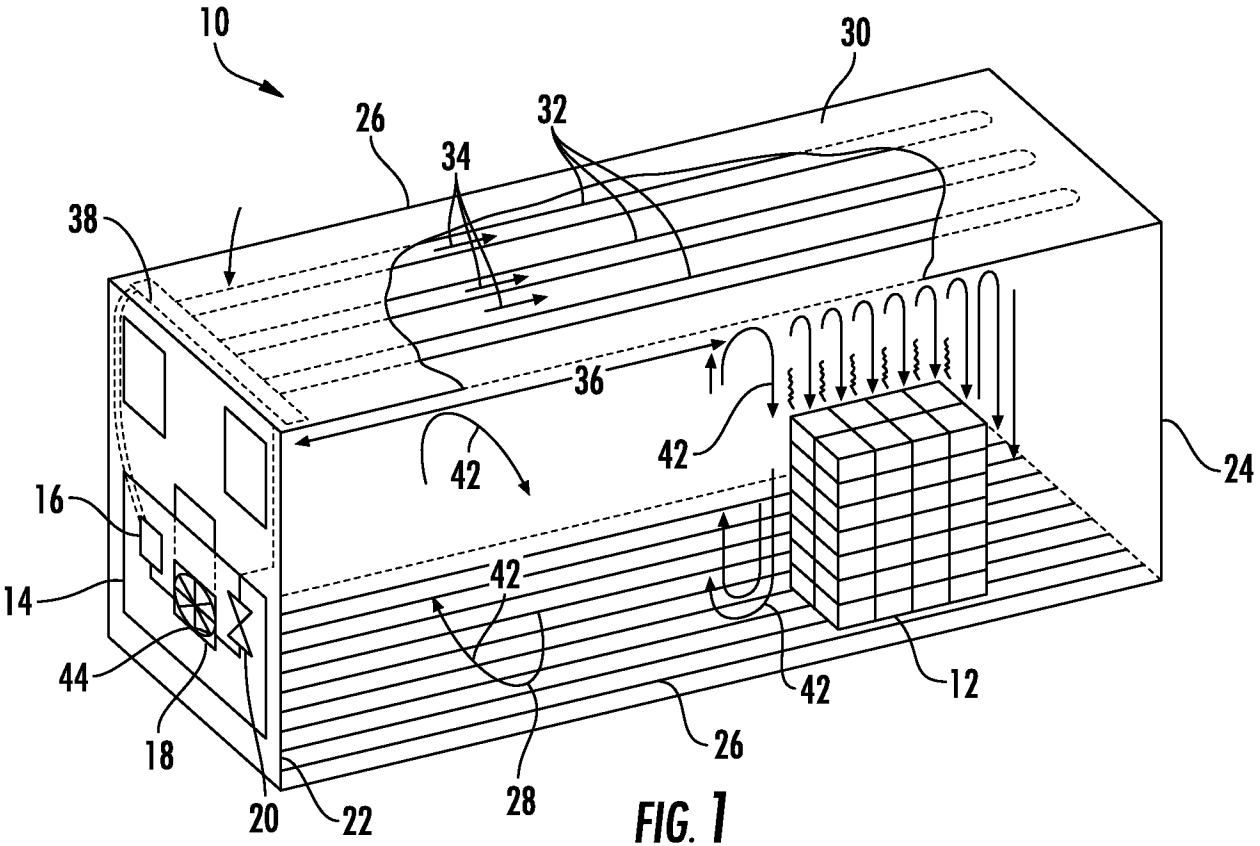
FIG. 1 is a cutaway view of an embodiment of a refrigerated cargo container.

The detailed description explains embodiments of the invention, together with advantages and features, by way of example with reference to the drawing.

DETAILED DESCRIPTION OF THE INVENTION

Shown in FIG. 1 is an embodiment of a refrigerated cargo container 10. The cargo container 10 is configured to maintain a cargo 12 located inside the cargo container 10 at a selected temperature through the use of a refrigeration unit 14 located at the container 10. The cargo container 10 is mobile and is utilized to transport the cargo 12 via, for example, a truck, a train or a ship. The refrigeration unit 14 includes (as schematically shown in FIG. 1) a compressor 16, a condenser 18 and an expansion valve 20 located at, for example, a first end 22 of the container 10. The container 10 further includes a second end 24 located opposite the first end 22, and two sidewalls 26, a floor 28 and a roof 30 located between the first end 22 and the second end 24.

Figure 2:
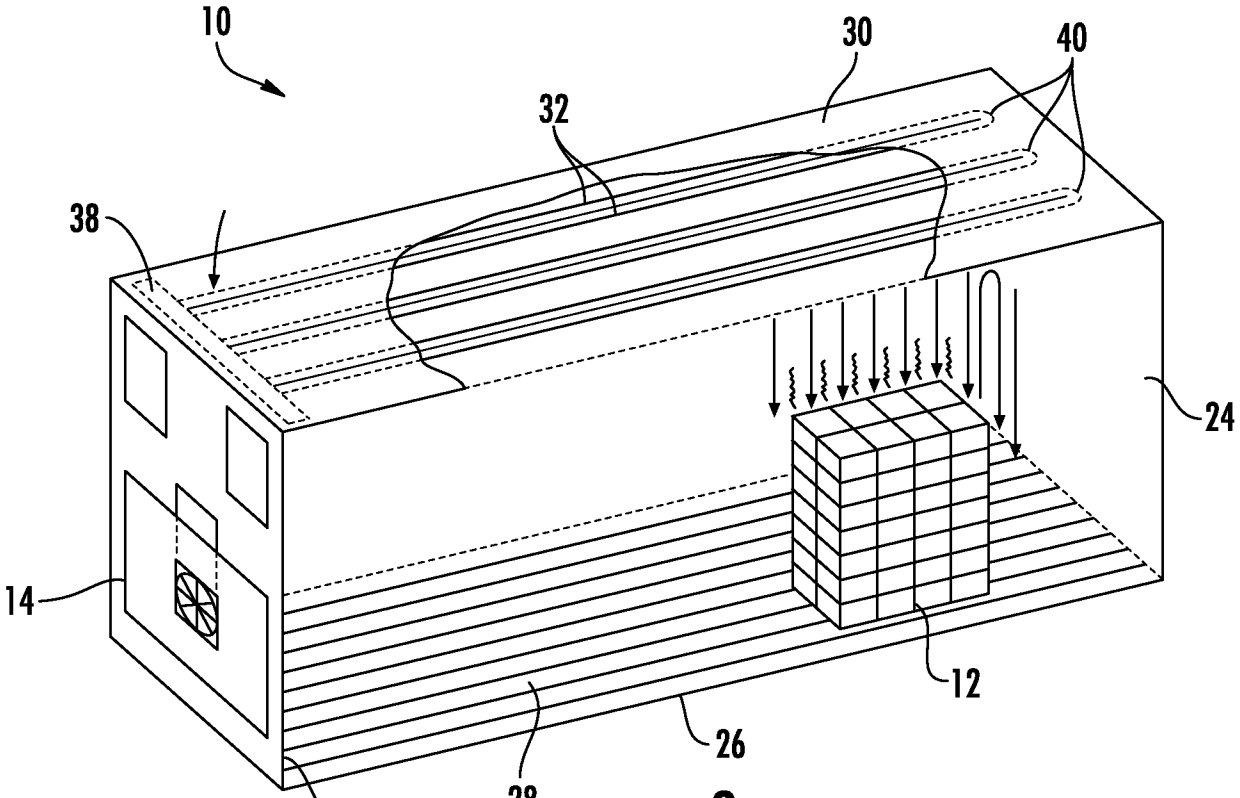
FIG. 2 is a cutaway view of another embodiment of a refrigerated cargo container.

Instead of a traditional evaporator of the typical cargo container refrigeration unit, the container 10 includes a plurality of refrigerant tubes 32 located at the roof 30 of the container 10, formed of highly thermally conductive material such as an aluminum or copper material. The plurality of refrigerant tubes 32 are connected to the expansion valve 20 and the compressor 16 of the refrigeration unit 14, and convey a flow of refrigerant 34 throughout the refrigerant tubes 32 from the expansion valve 20 to the compressor 16. The refrigerant tubes 32 extend along a length 36 of the roof 30 from a header 38. The refrigerant tubes 32 may be substantially straight, or alternatively as shown in FIG. 2, may have a u-bend 40 at or near the second end 24 of the container 10. Referring again to FIG. 1, with cold refrigerant 34 circulating through the refrigerant tubes 32, a natural convective flow is established in the container 10 to cool the cargo 12. Container air 42 closest to the refrigerant tubes 32 is cooled by the refrigerant flow 34, transferring thermal energy from the container air 42 to the refrigerant, and falls toward the floor 28, thereby cooling the cargo 12 via thermal energy transfer from the cargo 12 to the container air 42. The falling container air 42, forces warmer air located near the floor 28 to rise toward the roof 30, where it is cooled by the refrigerant flow 34 through the refrigerant tubes 32. This continuous natural convective cycle eliminates a need for an evaporator fan to urge cool air into the container, thus reducing system cost and footprint. To introduce a selected amount of fresh air into the container 10, the condenser 18 includes a condenser fan 44 utilized both for operation of the condenser 18 and introduction of fresh air into the container 10.

Figure 4:
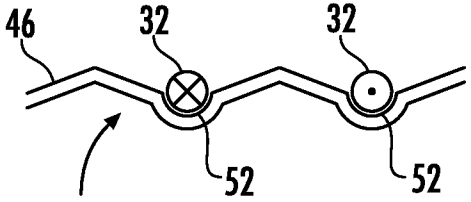
FIG. 4 is a cross-sectional view of a portion of an embodiment of a roof of a refrigerated cargo container.
Figure 3:
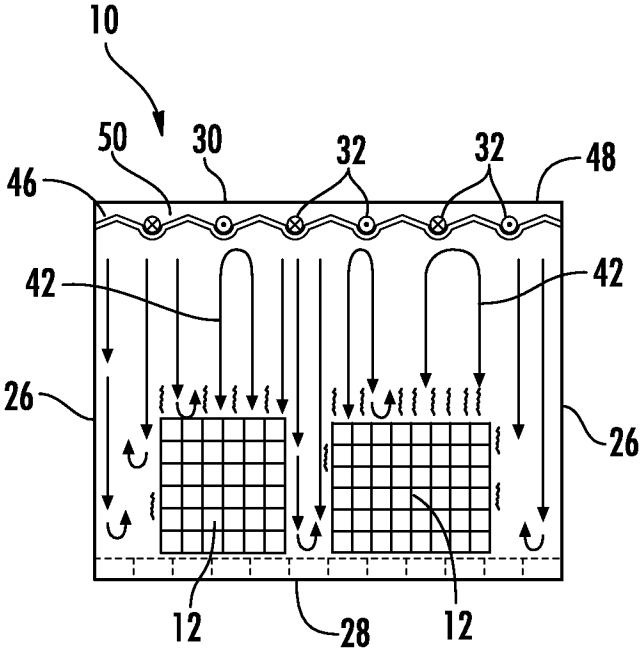
FIG. 3 is an end cross-sectional view of an embodiment of a refrigerated cargo container.

Referring now to FIG. 3, the plurality of refrigerant tubes 32 may be located at an inner roof panel 46 a distance lower than an outer roof panel 48. In inner roof panel 46, has a sinusoidal or other contoured shape to accept the refrigerant tubes 32 and to increase a surface area of the inner roof panel 46, thereby improving heat transfer between the container air 42 and the inner roof panel 46. In some embodiments, a space between the inner roof panel 46 and the outer roof panel 48 is at least partially filled with an insulating material 50. Referring now to FIG. 4, in some embodiments, the inner roof panel 46 includes channels 52 receptive of the plurality of refrigerant tubes 32. The channels 52 may be C-shaped to receive circular refrigerant tubes 32, or have another cross-sectional shape to receive refrigerant tubes 32 of another cross-sectional shape.

Figure 5:
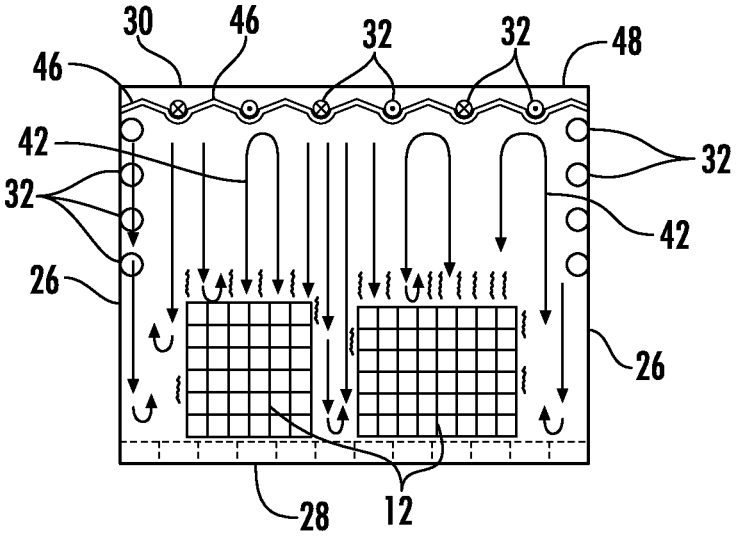
FIG. 5 is an end cross-sectional view of another embodiment of a refrigerated cargo container.

Referring again to FIG. 3, one embodiment includes six refrigerant tubes 32 along the roof 30, while other embodiments may include other quantities of refrigerant tubes 32 for example, 8, 12, 16 or 24 or more refrigerant tubes 32 along the roof 30. In other embodiments as shown in FIG. 5, the container 10 may alternatively or additionally include a plurality of refrigerant tubes 32 extending along one or more of the sidewalls 26. The inclusion of refrigerant tubes 32 along the sidewalls 30 in addition to those along the roof 30 further increases the cooling capacity of the container 10. The refrigerant tubes 32 along the sidewalls 26 may extend from the same header 38 as the refrigerant tubes 32 along the roof 30, or may extend from separate headers 38 in the sidewalls 26. To even further increase cooling capacity and distribution, refrigerant tubes 32 may additionally be included in the floor 28 of the container 10.

In a traditional refrigerant unit there is no radiative effect for cooling or heating. In the unit 14 the entire roof 30 and sidewall 26 surface is in visible contact with the cargo 12 and the thermal radiant cooling effect is very significant. The radiant effect does not involve air but relies on changing the motion of charged particles of matter. As long as the radiative surface (the plurality of tubes 32 and roof 30) has a direct path to the cargo 12, the radiant effect can be a large percentage of the overall cooling capacity. This method is typically small in traditional "forced air" designs.

In some embodiments, in addition to providing cooling, the refrigerant tubes 32, such as those located in the floor 28 of the container 10 are used to provide heating to the cargo 12. In such embodiments, the unit 14 conveys hot gas from the compressor 16 to the evaporator refrigerant tubes 32 to heat the refrigerant therein. The refrigerant 32 then is flowed through the tubes 32 and transfers thermal energy to the cargo 12, thus heating the cargo 12. Heating of the cargo as described herein may be required when the ambient temperature is very low and the cargo 12 requires a set point above the ambient temperature.

Figure 6:
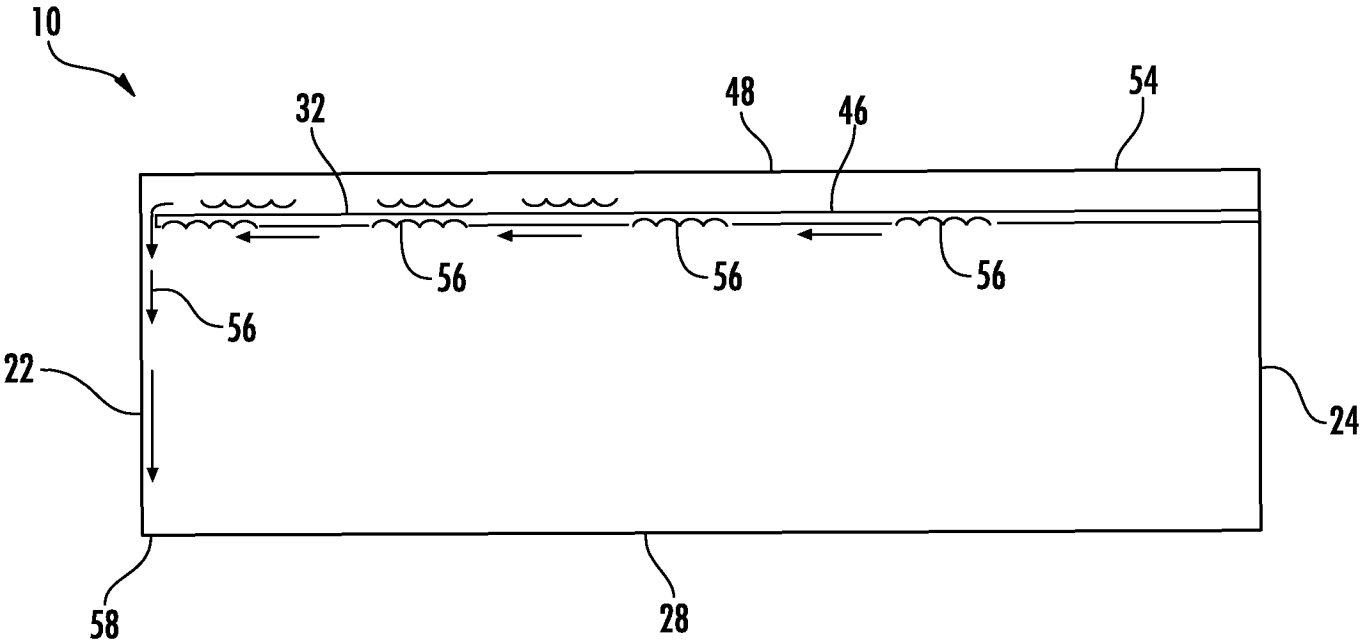
FIG. 6 is a side cross-sectional view of an embodiment of a refrigerated cargo container.

As shown in the side view of FIG. 6, the refrigerant tubes 32 and the inner roof panel 46 are positioned at a roof angle 54 nonparallel to horizontal, to control drainage of condensate 56 that accumulates on the refrigerant tubes 32 and the inner roof panel 46. For example, the refrigerant tubes 32 and inner roof panel 46 may be positioned at a roof angle 54 such that condensate 56 flows along them from the second end 24 toward the first end 22, with the inner roof panel 46 and refrigerant tubes 32 positioned higher at the second end 24 than at the first end 22 so the condensate 56 flows with gravity toward a drain 58. In other embodiments, the container 10 may be similarly configured to flow condensate 56 form the first end 22 toward the second end 26, or from a first sidewall 26 toward a second sidewall 26. Additionally, some embodiments may include slits, fins or other features in the inner roof panel 46 to enhance heat transfer.

Integrating refrigerant tubes 32 into the roof 30 and/or other elements of the container 10 saves cost and reduces complexity of the container 10 and refrigeration unit 14 through elimination evaporator fan of a typical refrigeration unit, and related components. Further, due to the airflow being driven primarily by natural convection, power consumption of the refrigeration unit is reduced. Additionally, since the refrigerant tubes 32 extend over the length of the container 10, cooling from the refrigeration unit 14 is more evenly distributed from end to end of the container 10, as compared to the conventional container where cooling air is forced into the container only from one end of the container and warms along the length of the container.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A method of cooling a cargo in a cargo container comprising:

flowing a refrigerant through a plurality of refrigerant tubes disposed in a roof cavity of the cargo container, the roof cavity defined by an outer roof panel and an inner roof panel spaced from the outer roof panel;

transferring thermal energy from container air in the container to the refrigerant thereby cooling the container air;

circulating the container air via natural convection toward the cargo disposed in an interior of the cargo container defined between the inner roof panel and a floor of the cargo container thereby cooling the cargo via thermal energy transfer to the container air;

recirculating the container air toward the plurality of refrigerant tubes; and directing condensate toward a selected location in the cargo container; via:

disposing the plurality of refrigerant tubes at an angle nonparallel to horizontal; and flowing the condensate toward the selected location via gravity.

2. The method of claim 1, further comprising transferring thermal energy between the plurality of refrigerant tubes and the cargo via thermal radiation.

3. The method of claim 1, further comprising:

flowing the refrigerant from the refrigerant tubes through a compressor;

flowing the refrigerant from the compressor through a condenser;

flowing the refrigerant from the condenser through an expansion valve; and flowing the refrigerant from the expansion valve into the plurality of refrigerant tubes.

4. The method of claim 3, further comprising flowing the refrigerant from the expansion valve through a header and into the plurality of refrigerant tubes.

5. The method of claim 1, further comprising flowing a volume of fresh air into the cargo container via a fan.

6. The method of claim 5, wherein the fan is a condenser fan.

7. The method of claim 1, further comprising flowing refrigerant through the plurality of refrigerant tubes disposed at one or more sidewalls of the cargo container.

8. A method of heating a cargo in a cargo container comprising:

heating a flow of refrigerant disposed in a plurality of tubes;

flowing the flow of refrigerant through the plurality of tubes at the cargo container;

transferring thermal energy from flow of refrigerant to container air in the container thereby heating the container air;

circulating the container air via natural convection toward the cargo thereby heating the cargo via thermal energy transfer from the container air;

recirculating the container air toward the plurality of tubes; and directing condensate toward a selected location in the cargo container; via:

disposing the plurality of refrigerant tubes at an angle nonparallel to horizontal; and flowing the condensate toward the selected location via gravity.

9. The method of claim 8, further comprising transferring thermal energy between the plurality of refrigerant tubes and the cargo via thermal radiation.

10. The method of claim 8, further comprising:

flowing the refrigerant from the refrigerant tubes through a compressor;

flowing the refrigerant from the compressor through a condenser;

flowing the refrigerant from the condenser through an expansion valve; and flowing the refrigerant from the expansion valve into the plurality of refrigerant tubes.

11. The method of claim 10, further comprising flowing the refrigerant from the expansion valve through a header and into the plurality of refrigerant tubes.

12. The method of claim 8, further comprising flowing a volume of fresh air into the cargo container via a fan.

13. The method of claim 12, wherein the fan is a condenser fan.

14. The method of claim 8, further comprising flowing refrigerant through the plurality of refrigerant tubes disposed at one or more sidewalls of the cargo container.

* * * * *